US007316324B1

(12) United States Patent
Myllykangas

(10) Patent No.: US 7,316,324 B1
(45) Date of Patent: Jan. 8, 2008

(54) COMPACT RETRACTABLE TOWEL BAR

(76) Inventor: Martin W. Myllykangas, 15 Carter Rd., Westminster, MA (US) 01423

( * ) Notice: Subject to any disclaimer, the term of this patent is extended or adjusted under 35 U.S.C. 154(b) by 0 days.

(21) Appl. No.: 11/151,858

(22) Filed: Jun. 8, 2005

(51) Int. Cl.
*A47K 10/00* (2006.01)

(52) U.S. Cl. ..... 211/16; 211/105.1

(58) Field of Classification Search ..... 211/16, 211/6, 88.04, 105.1, 123, 96, 99; 248/256, 248/257, 265, 269, 271, 272, 683, 205.3
See application file for complete search history.

(56) References Cited

U.S. PATENT DOCUMENTS 1,202,190 A * 10/1916 Kern ..... 242/565
1,476,034 A * 12/1923 Banks ..... 211/99
1,613,354 A * 1/1927 Mathes ..... 211/16
1,751,777 A * 3/1930 Victorsohn ..... 211/99
2,087,757 A * 7/1937 Foss ..... 211/119.008
2,379,975 A * 7/1945 Luger ..... 211/99
2,606,667 A * 8/1952 Hornick ..... 211/124
5,119,948 A * 6/1992 Hallgrimsson ..... 211/183
5,373,950 A * 12/1994 Marc ..... 211/88.04
5,642,462 A * 6/1997 Huff ..... 392/382
6,105,795 A * 8/2000 Terragni ..... 211/100
6,152,312 A * 11/2000 Nava et al. ..... 211/94.01
6,561,364 B1 * 5/2003 Brunsden ..... 211/90.01
6,726,036 B2 * 4/2004 Koellner ..... 211/104

* cited by examiner

*Primary Examiner*—Jennifer E. Novosad
(74) *Attorney, Agent, or Firm*—Martin W. Myllykangas

(57) ABSTRACT

An assemblage of mechanical components that provide support for hanging towels and for storing towels in a compact position for drying. The extension of the towel bar to an extended detented position provides sufficient clearance for hanging a towel. A modified keyhole type slot in the towel bar support has resident upper and lower notches. An integral square pivot pin located at the end of and at a right angle to the towel rod arm inserts into the modified keyhole. When the towel bar is lifted and pulled forward to the towel hanging mode, the square pivot pin is detented in the narrower portion of the modified keyhole thus creating a locked position. After towel hanging, the towel bar is lifted upwards and then pushed rearward. The square pivot pin then freely rotates in the larger portion of the keyhole. The towel bar is then rotated downward to a compact storage position for towel drying.

6 Claims, 8 Drawing Sheets

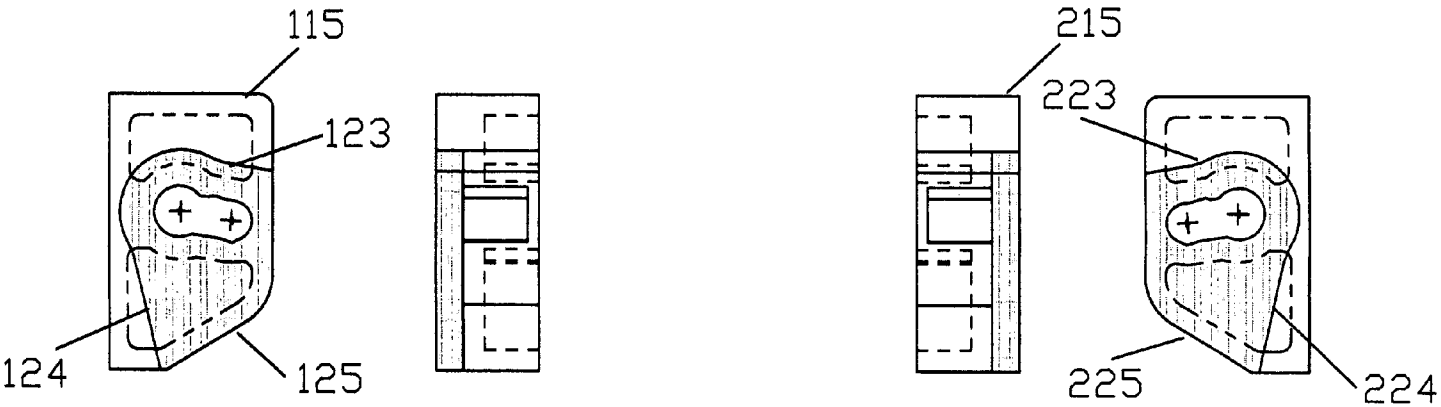
FIG. 6A
FIG. 6B
FIG. 7A
FIG. 7B
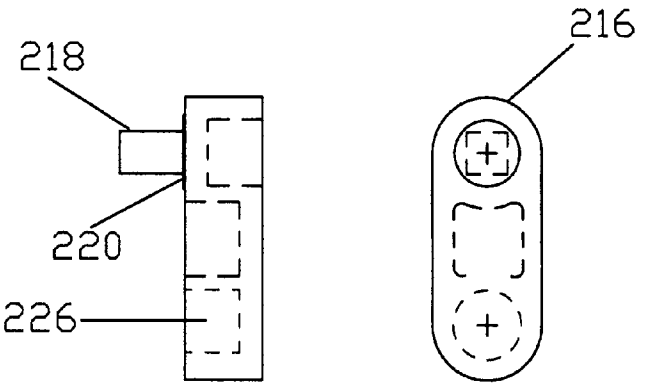
FIG. 8A
FIG. 8B
FIG. 9A
FIG. 9B

FRONT VIEW

COMPACT RETRACTABLE TOWEL BAR

FEDERALLY SPONSORED RESEARCH

Not Applicable

SEQUENCE LISTING OR PROGRAM

Not Applicable

BACKGROUND

1. Field of Invention

This invention is a compact retractable towel bar assembly of which a towel bar rod is designed to an extended detented mode for hanging items to dry such as hand towels, dish towels, washcloths, clothes and paper goods. Said towel bar rod is capable of retracting from said extended detented mode to an intermediary non-detented mode and then further to rotate downward to a compact towel drying position. An ideal application of said compact retractable towel bar assembly is when said assembly is attached to a fixed drawer front panel normally located in front of a kitchen sink cabinet. This towel bar location provides optimum access for hanging towels, eliminates access to handles of kitchen appliances to hang towels, and eliminates human bodily interference when said compact retractable towel bar is in said compact towel drying position.

Note:

a.) In the discussions to follow, said compact retractable towel bar will be referred to as the "towel bar" for brevity.

b.) In the discussions to follow, reference to arm and support appear in the singular for the left end assembly of said towel bar. It is implied that this reference applies to the right end of said towel bar which is constructed in an identical but right-handed manner.

2. Description of Prior Art

It has been observed especially in kitchens, that hand towels and dish drying towels are placed to dry on oven door handles, refrigerator door handles, towel racks inside of cabinet doors and other less desirable or remote locations. Placing a towel in these remote locations is an unplanned alternative for lack of a properly designed and specifically located towel bar. The action of placing a towel on said appliances handles could interfere with another human in close proximity. A better alternative is to install a towel bar right below the sink counter top where the distance from the sink basin to the towel is a practical minimum. The selection of this location will provide as close an access to hanging towel for hand drying and secondly, eliminate a person's arm from colliding with another person close by when attempting to store a towel for drying.

It is generally observed that towel bars project a certain fixed distance from the surface that they are mounted to. This projection precludes applications of the types of towel bar assemblies that protrude into a person's frontal body mid-section when they are standing at a water basin such as a sink or lavatory. As naturally observed, this is not a desirable practice due to poor ergonomic parameters.

Prior art U.S. Pat. No. 5,373,950[1994] illustrates a plurality of towel bars with the assembly projection from the surface to which it is mounted appearing to be in multiple inches. It is obvious that this projection prohibits applications of this device immediately in front of a kitchen sink where a person is normally positioned when washing items. Although the lowest bar on this sub-assembly can be retracted horizontally towards the mounting base, the remaining and fixed upper bar assemblies project excessively from the mounting surface negating usage in front of a kitchen or bathroom sink. Therefore application of said towel rack apparatus is not adaptable to locations immediately in front of a kitchen sink. My invention, as further described, has an ideal application, typically, on a stationary drawer panel of a kitchen sink cabinet as seen from the following drawings where the projection from the mounting surface in said towel storage/aeration position is only one and one-half inches. Further, where it is desired to mount a towel bar on a stationary drawer panel of a sink cabinet in a mobile home or trailer where isle space is restricted, said towel bar has an ideal application.

OBJECTS AND ADVANTAGES

Besides the objects and advantages of said towel bar described in my invention above, several additional objects and advantages of said invention are:

a.) To provide a means of mounting said towel bar without screws or similar hardware by means of double-sided adhesive foam tape b.) To provide immediate attachment of said towel bar in a simple manner by removing the release tape and pressing said towel bar supports to a fixed drawer front by non-technical persons c.) To provide an unmarred mounting surface from which said towel bar was attached upon removal of said towel bar d.) To provide use of various colors of metal, plastic or hard wood materials for constructing said towel bar for matching kitchen or bathroom decorating schemes e.) To provide for protected aluminum, iron, metal, fiberglass, or other composite towel bar materials for said towel bar design for residential, commercial or industrial applications f.) To provide improved access to a lower cabinet interior by lifting said towel bar to said extended detented towel hanging mode, FIG. 5A, thereby placing the towel(s) at a greater distance from the cabinet door located below said fixed drawer front where said towel bar is mounted. Still further objects and advantages are clearly described from the following description and drawings.

SUMMARY

Said towel bar is comprised of assembled mechanical components that allow said towel bar to extend to said extended detented mode for hanging towels, retract to said non-detented intermediary mode and then rotate downward to said compact towel drying mode with projection of only one and one-half inches from the surface to which said towel bar is mounted.

DRAWINGS

Drawing Figures

References made to "towel" in this discussion include a hand towel, dish towel, bath towel, washcloth or similar item.

FIGS. 1 and 2 show in perspective views said towel bar in said extended detented towel hanging mode and, secondly, in said rotated downward compact towel drying mode.

In FIG. 3, an exploded view of the left end of said towel bar assembly is shown depicting said pivot pin associated with said support.

FIGS. 4A and 4B show said towel bar modified keyhole as viewed from the side. FIG. 4A depicts the detail of said modified keyhole showing the two detents 114 in the reduced portion of said keyhole. These said detents are designed to allow said rotating pin 118 integral with said arm, FIG. 8B, to lock into an extended detented position FIG. 4B. This action provides a firmly locked position of said towel bar for towel hanging. It also prevents the racking of said towel bar when it is in the extended detented towel hanging mode. FIG. 4B shows the positioning of said pin in said extended detented towel hanging mode.

FIGS. 6 & 7 show the detailed views of said towel bar supports and arms. The shaded areas highlight the recessed surface in which my design provides upper and lower limits 123 & 124 for said rotating arms (FIGS. 8B & 9A) to travel.

FIGS. 8B & 9A show said left and right arms incorporating said square pivot pins. The lower larger recessed hole 126 of said arm is for inserting and securing said towel bar rod.

FIG. 8B shows said square pivot pin which provides axial support for said arm and said square pivot pin protrudes into said modified keyhole 119 in said support. A molded boss 120 on said arm and at the base of said square pivot pin is positioned between said rotating arm and said support that acts as a thrust washer to prevent scoring or binding of the two mechanical members as they rotate against each other.

Figure 10:
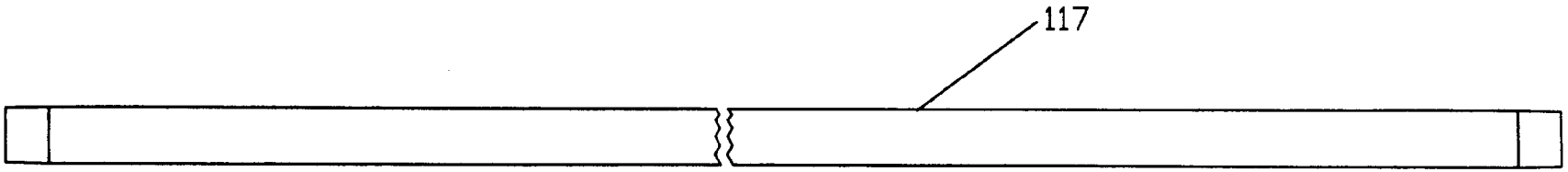

FIG. 10 shows a variable length towel bar rod. An end of said towel bar rod is inserted into the larger recessed hole of said arm and welded permanently to said arm.

Figure 11:
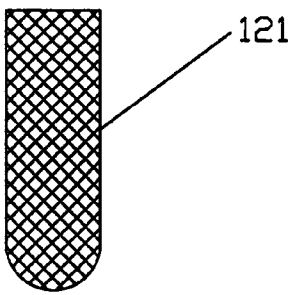

FIG. 11 shows said double-sided adhesive foam tape mounted on said support and utilized for attaching said towel bar to a vertical surface such as said kitchen sink cabinet fixed drawer front panel.

Reference Numerals In Drawings

| | | | |
|---|---|---|---|
| 115 & 215 | Left/right hand supports | 116 & 216 | Left/right hand arms |
| 117 | Towel Rod | 118 & 218 | Left/right hand pivot pins |
| 119 & 219 | Left/right hand keyholes | 120 & 220 | Left/right hand bosses |
| 121 & 221 | Left/right hand double-sided foam tape | 122 | Towel (simulated) |
| 126 & 226 | Left/right hand towel bar holes | | |

DETAILED DESCRIPTION

Figure 1:
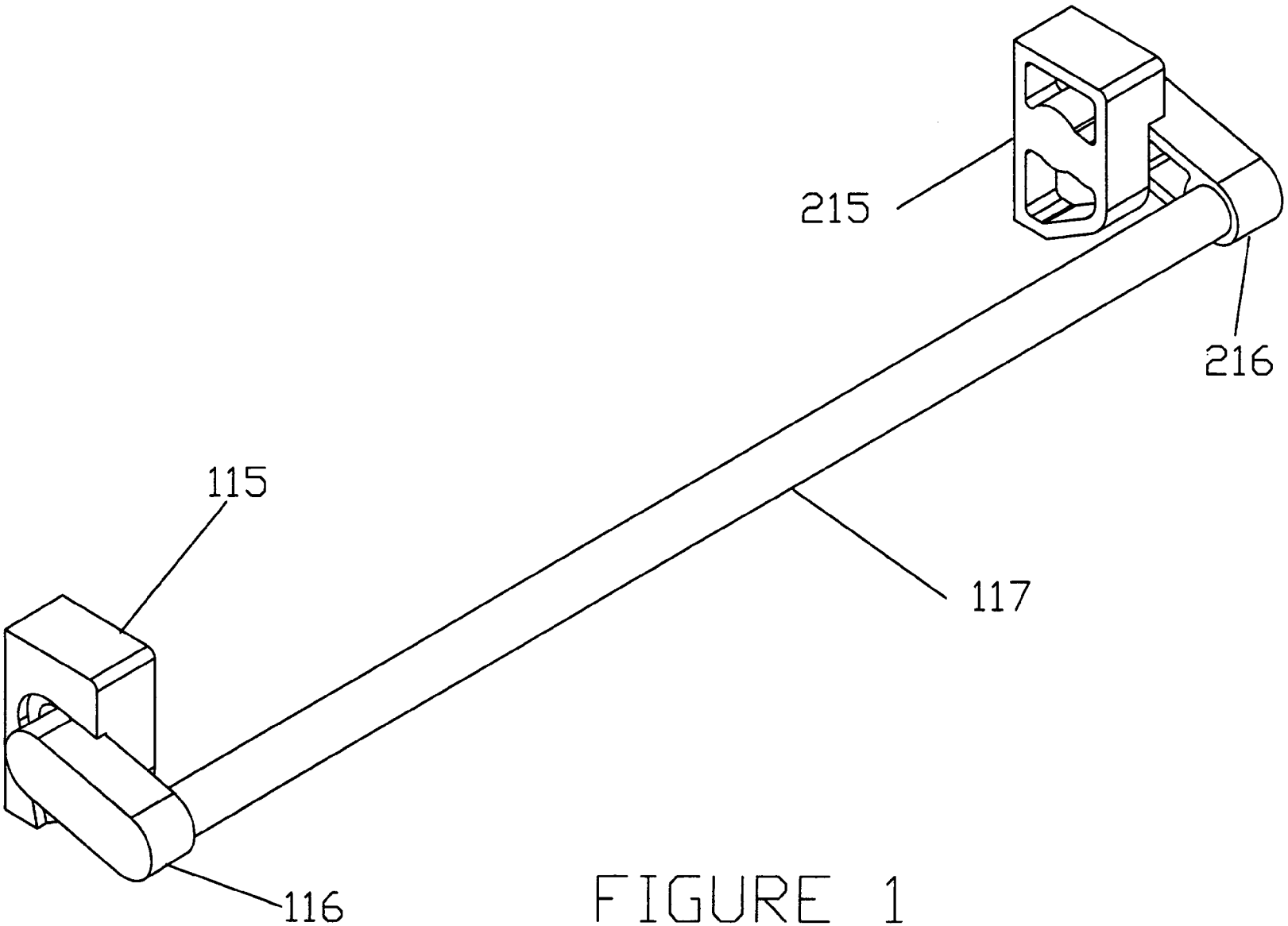
Figure 2:
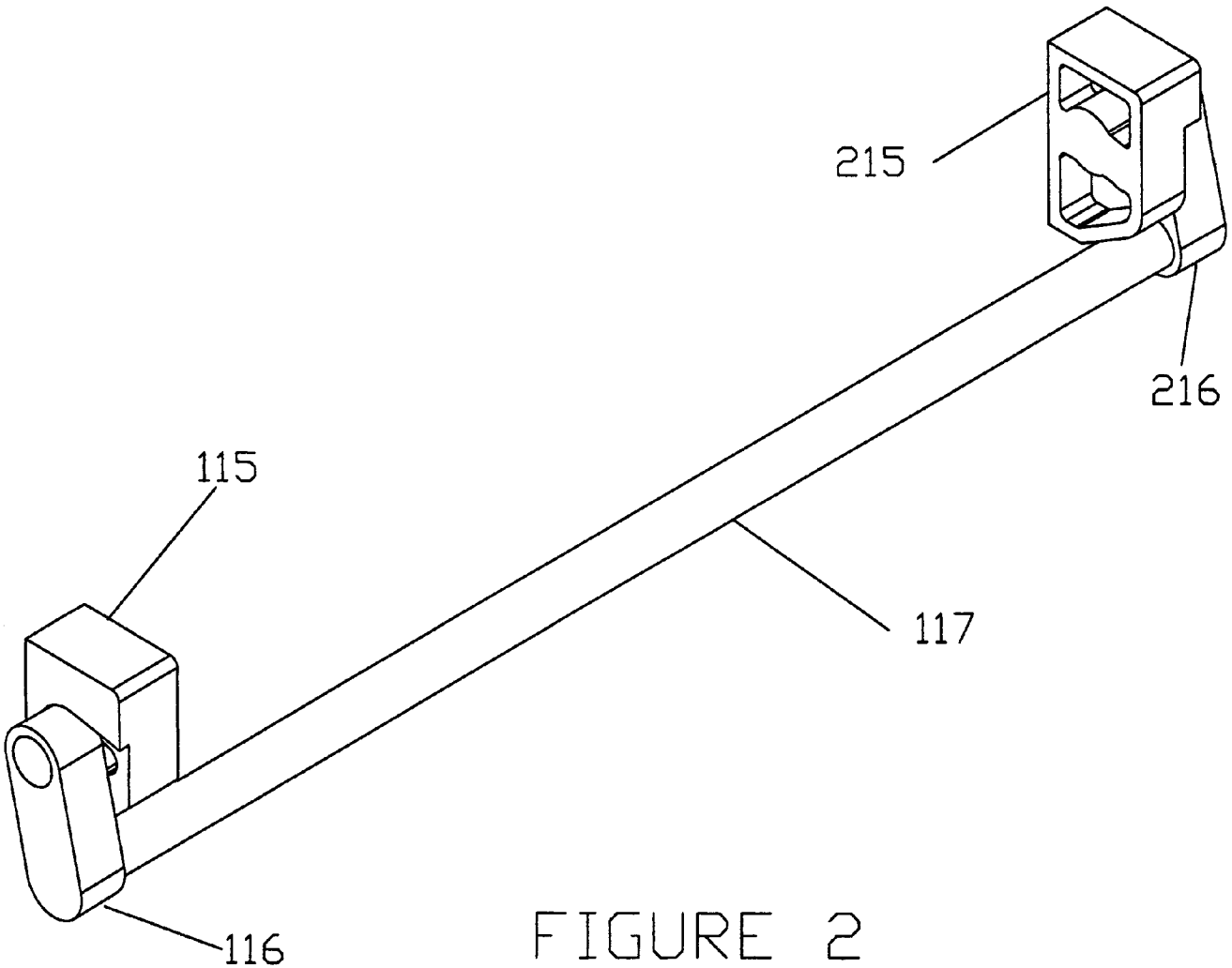
Figure 3:
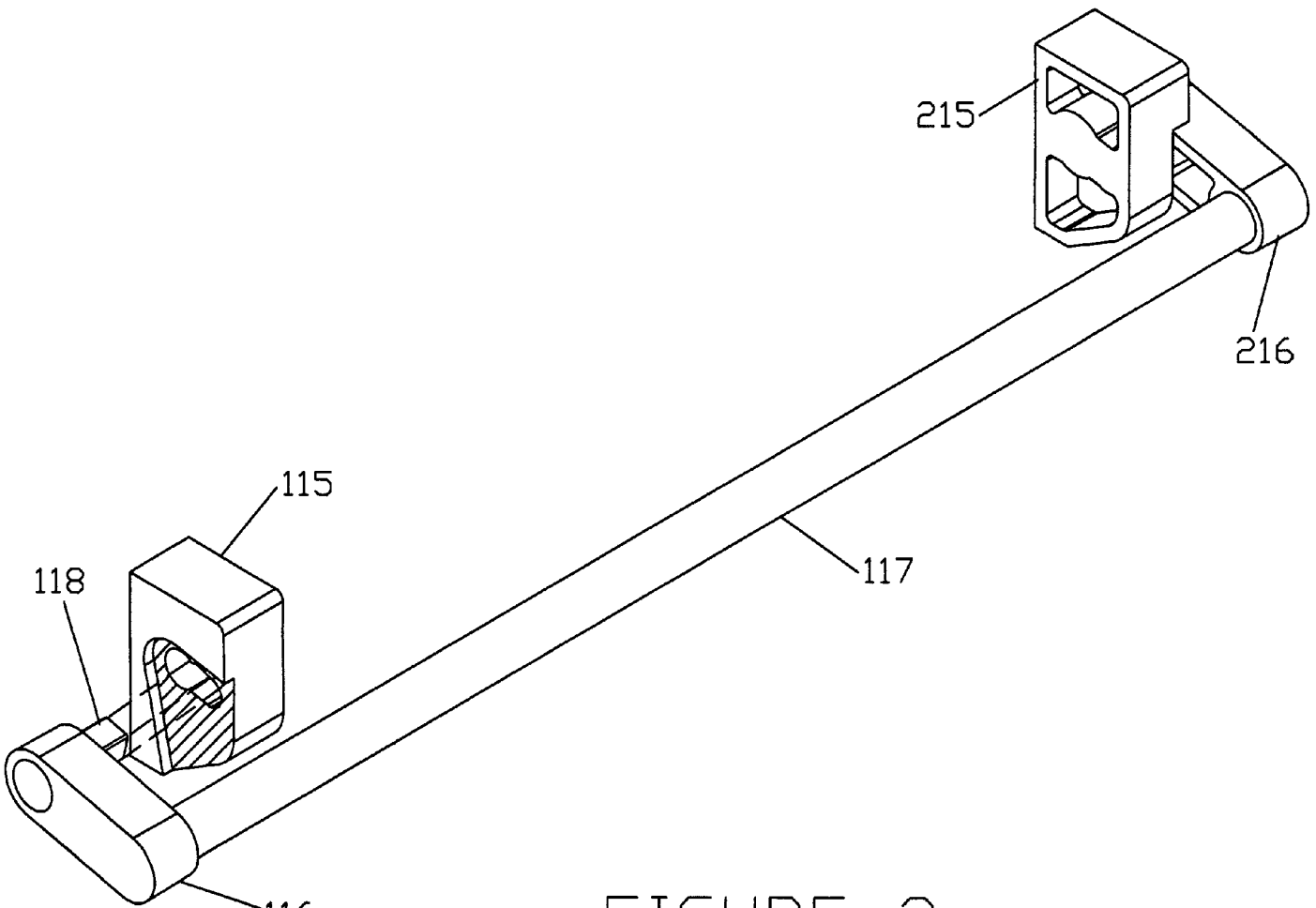

Description—FIGS. 1 & 2—Preferred Embodiment

The preferred embodiment of said towel bar is illustrated in FIG. 1, said extended detented towel hanging mode and FIG. 2, said retracted/rotated downwards compact towel drying mode. Said towel bar rod, FIG. 10, is shown as a variable length to accommodate varying fixed drawer front panel or vertical bulkhead surface lengths to which said towel bar is to be attached. It is also of variable length for user application of towel(s) width. Said intermediary non-detented position is not shown in this perspective view, but is shown as an end view in FIG. 5B for viewing of this design feature. When said towel bar is in said extended detented towel hanging mode, FIGS. 1 & 5A, the inner radius of said towel bar rod is approximately two and one-half inches from the mounting surface to which said towel bar is mounted. In this position, there is ample room to hang a towel on said towel bar rod. When said towel bar rod is retracted and rotated down, FIGS. 2 & 5C, the inner radius of said towel bar rod is approximately five-eighths of an inch from said vertical mounting surface which allows for towel drying. Also, when in this position, said arms which are attached to said towel bar rod, do not project beyond the outermost projection of said towel bar supports. This eliminates objectionable bodily interference for a person working in front of a sink at said towel bar location.

Figure 4A:
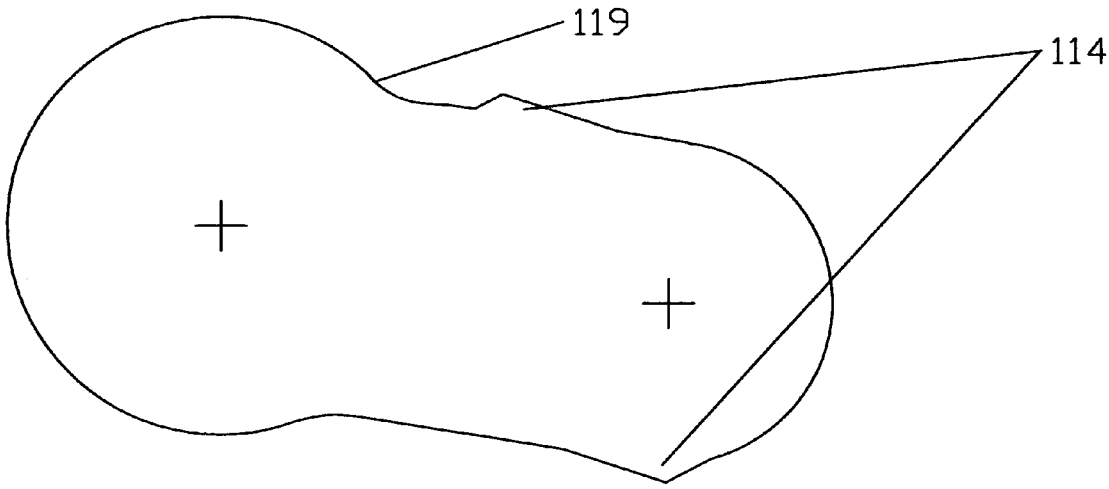
Figure 5C:
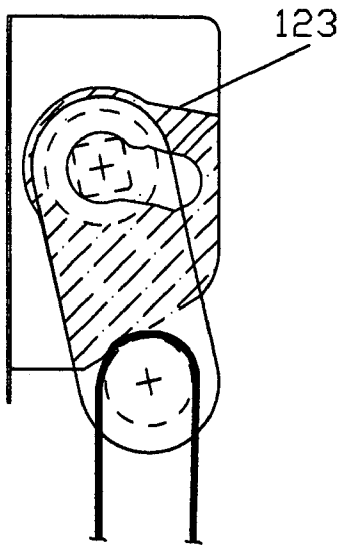
FIGS. 5A, 5B and 5C show the left end view respectively of: a.] Said towel bar in said extended detented towel hanging mode b.] Said towel bar in said retracted non-detented intermediary mode c.] Said towel bar in said compact towel drying mode.
Figure 5B:
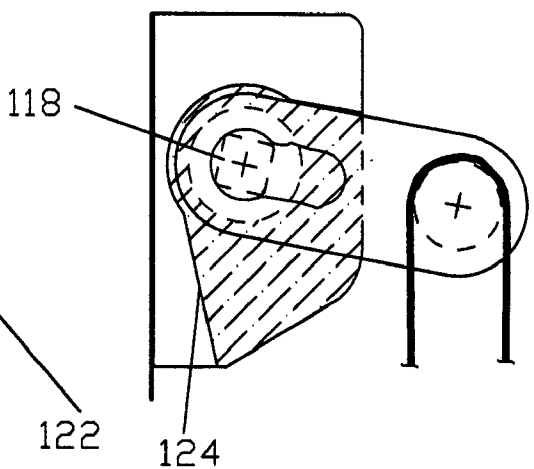
Figure 5A:
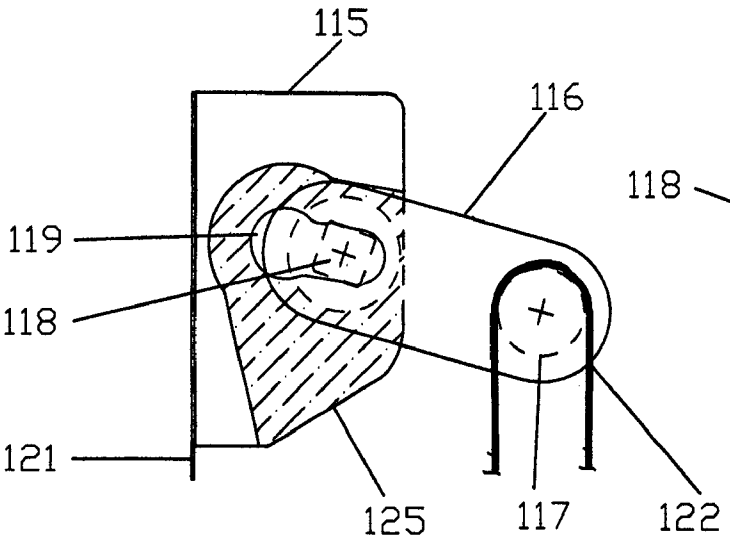

In FIG. 5A, the detail of said square pivot pin design positioned in said modified keyhole 119 depicts the mechanical design for said extended detented towel hanging mode. Note that said square pivot pin 118, molded as an appendage of said arm, FIGS. 8B & 9A, is captured in the forward portion of said modified keyhole 119 and unable to rotate. Said modified keyhole aperture is radially positioned 10° downward from the horizontal axis to reduce the possible inadvertent retraction of said towel bar to said intermediary non-detented position, FIG. 5B, when a towel is being placed on said towel bar rod. In the reduced portion of said keyhole aperture, two notches 114 in FIG. 4A, one on said upper keyhole plane and one on said lower keyhole plane are designed to detent said square pivot pin(s) 118 in said extended detented towel hanging mode thereby preventing said towel rod and said arm from rotating. A recessed area in said support, shown shaded in FIG. 6A. is where said arm has a resident arm upper limit 123 to facilitate positioning of said square pivot pin to said reduced modified keyhole aperture when said towel bar rod is extended. FIGS. 8B & 9A illustrate the boss (0.010 inch thick) on said arms at the base of said square pivot pins to provide a separation between said arms and said supports thereby preventing binding and/or scoring of these two components upon rotation against each other.

FIG. 5B shows said towel bar rod retracted with said square pivot pins positioned in the larger hole of said modified keyhole aperture 119; this position is said non-detented intermediary mode. Said arm upper limit 123 feature acts as a guide for said arm when said towel bar rod is retracted. Said square pivot pin is now captured in the larger portion of said modified keyhole aperture 119 in said support, FIGS. 6A & 7B, and allows said arms to rotate radially downwards to the resident lower limit 124 of said towel bar support.

Figure 4B:
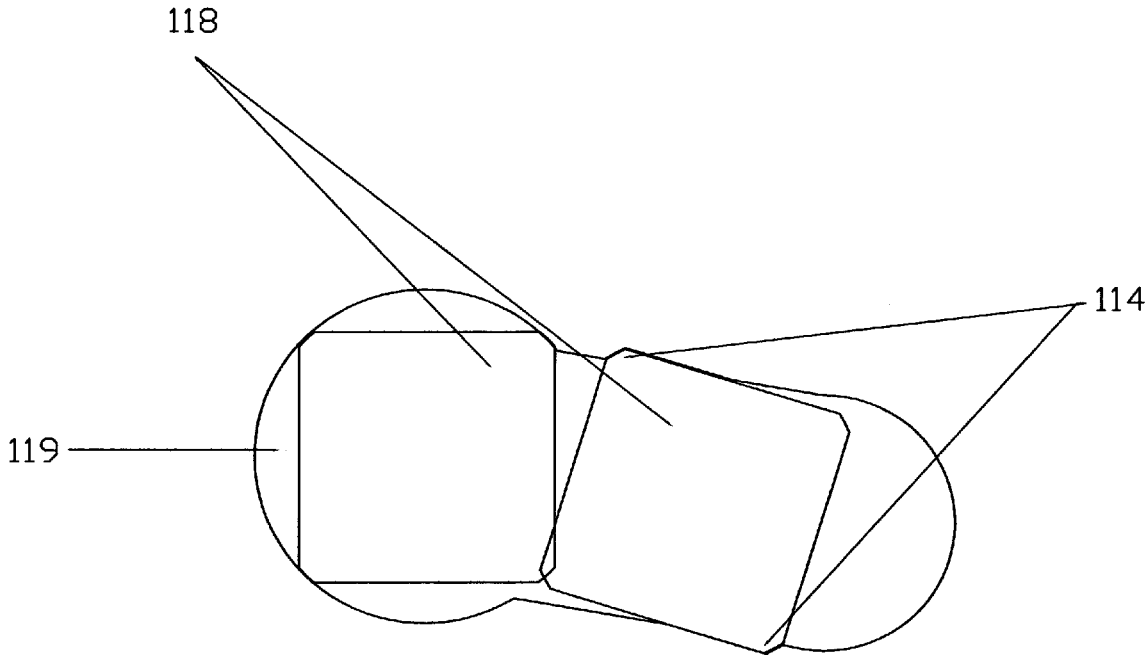

FIG. 5C shows said towel bar rod in the rotated downward mode for compact towel drying of towels. Said square pivot pin 118 is captured in said larger hole of said modified keyhole aperture by three points FIG. 4B of said square pivot pin. Said square pivot pin, in this instance, cannot migrate out of said larger hole of said modified keyhole aperture nor is it oriented axially for positioning into the smaller portion of said modified keyhole aperture. Said recessed area of said towel bar support has said resident arm lower limit 124 to prevent said arm from rotating further towards said support mounting surface. The outer diameter of said towel bar rod contacts the sloped lower surface 124 of said support simultaneously thereby limiting further downward rotation of said towel bar rod and said arm.

FIG. 10 illustrates the varying length of said towel bar 117. The end of said towel bar is inserted into the recessed hole of said arm 126, FIG. 8, and chemically welded to said arm.

In FIG. 5C, the total projection of said towel bar assembly from said towel bar mounting surface is a compact one and one-half inches. Therefore the application appears to be an ergonomically acceptable installation for a person standing immediately in front of a kitchen sink below which said towel bar is mounted, for instance, on said drawer front panel.

Said adhesive tape shown in FIG. 13 is a double-sided adhesive foam tape 121 of which one side is installed on said support, FIG. 5A, at said towel bar point of manufacture with the outer side retaining a protective release strip. Said release strip is removed prior to mounting of said towel bar to a vertical surface.

Description—Additional Embodiments

1.) An additional embodiment to my invention is that said towel bar can be designed to incorporate two towel bar rods at a fixed distance apart from each other on modified arms to permit doubling of compact towel drying.

2.) Said towel bar can be designed with additional supports in series thus accommodating a longer towel bar rod for greater towel hanging capacity.

3.) Said towel bar can be manufactured in various colors such as black, white, beige, gray and translucent plastics to aid selection for user desired decors. When certain components of said towel bar, such as said support, arm and towel bar are manufactured in hardwoods or metals, various stains, paints, and protective clear coats provide a variety of colors to aid user decor selection and to provide protection from moisture laden towels.

Alternative Embodiments

Said towel bar can be supplied and not limited in various lengths to accommodate varying towel dimensions and also surface mounting space. The compact retractable towel bar provides application in kitchens, bathrooms, laundries, mobile homes and similar areas where:

Operation—FIGS. 1, 2, 5A, 5B, & 5C

Installation of said towel bar is accomplished with simple effort as follows:

1.) Select a vertical surface to mount said towel bar;

2.) Swab the two surface areas with a cleansing agent such as isopropyl alcohol where said supports will be applied and allow a few seconds to dry;

3.) Unpack said towel bar from package as purchased;

4.) Remove two release strips from said adhesive foam tape located on said supports;

5.) Ensure said supports are horizontally aligned. Then, holding both ends of said towel bar supports, firmly press said supports onto said mounting surface.

6.) Allow one hour for said adhesive foam tape to attain maximum adhesion;

The manner of using said towel bar is similar to all known towel bars where a towel is folded, or not folded, in the long dimension and suspended on a towel bar. Operation of said compact retractable towel bar follows:

1.) When said towel bar is mounted to a vertical surface, said towel bar rod is grasped approximately in the center and rotated upwards until it stops.

2.) Said towel bar rod is then pulled forward until it stops; this is said extended detented mode.

3.) A towel is placed on said towel bar rod.

4.) Said towel bar rod is pushed forward until it stops; this is said intermediary non-detented mode.

5.) Said towel bar rod is then lowered downwards until it stops rotating; this is said compact towel drying mode.

Removal of Said Towel Bar Assembly

To remove said towel bar from the surface to which it mounted, remove all items placed on said towel bar rod.

1.) Grasping one end of said towel bar support with one hand, locate the semi-circular tab at the lowest end of said adhesive strip and gently pull straight down until said tape is stretched approximately ten inches. Said tape will release at this point from its mounting surface and free said towel bar support from said mounting surface.

2.) Perform the identical operation at the opposite end of said towel bar. Said towel bar supports remain undamaged and ready for re-installation at another location. Also, the surface to which said towel bar was mounted remains undamaged.

CONCLUSION, RAMIFICATIONS AND SCOPE

Accordingly, the reader will see that the said towel bar of this invention can:

Be applied to kitchen, bathroom, and other similar sink fixed drawer fronts to provide an immediate location for hanging and drying towels especially where isle space is restricted and where ergonomic considerations demand minimal projection from a vertical mounting surface.

Remove said towel bar unit and relocate unit to another location without marring the mounting surface.

Re-install said towel bar simply by means of said double-sided adhesive tape strip.

Provide various component materials and colors for manufacture of said towel bar to accommodate user decor selection.

Although the descriptions above contain many details of my invention, these should not be construed as limiting the scope of my invention, but as merely providing illustrations of some of the preferred embodiments of this invention. For example, said support, arm, or towel bar can be made in smaller or larger dimensions to accommodate varying application requirements. Said arm with square pivot pins, said support with modified keyhole and said towel bar can be designed in other decorative shapes for esthetics and compliance with user refined product enhancements or specifications. Said towel bar can be designed with said dual towel bars for doubling of towel drying.

I claim:

1. An apparatus comprising:

at least one rod member having a first end and a second end;

at least two support members, each support member comprising at least one aperture; and at least two arm members, each arm member comprising at least one aperture adapted to receive one end of the rod member, and at least one pivot pin adapted to couple the arm member to one of the support members, where the pivot pins are substantially square-shaped.

2. The apparatus of claim 1, where each of the support member apertures are substantially keyhole-shaped and each of the support member apertures include at least two notches adapted to detent the substantially square-shaped pivot pins.

3. The apparatus of claim 2, where each of the support members further comprise means for limiting a lower movement of the arm members and means for limiting an upper movement of the arm members.

4. An apparatus comprising:

one rod member having a first end and a second end, where the first end is distal to the second end;

two support members, each support member comprising at least one substantially keyhole-shaped aperture, the substantially keyhole-shaped aperture having two notches;

two arm members, each arm member comprising a substantially square-shaped pivot pin adapted to rotatably couple the arm member to one of the support members, and each arm member further comprising an aperture adapted to receive one end of the rod member;

where the notches are adapted to detent the substantially square-shaped pivot pins.

5. The apparatus of claim 4, where each of the support members further comprise means for limiting a lower movement of the arm members and means for limiting an upper movement of the arm members.

6. The apparatus of claim 5, further comprising two adhesive strips, where one adhesive strip is coupled to each support member to adhere the support member to a vertical surface.

* * * * *